US005299777A

United States Patent [19]

Milstead

[11] Patent Number: 5,299,777

[45] Date of Patent: Apr. 5, 1994

[54] VALVED DRAIN PLUG APPARATUS

[76] Inventor: Brown W. Milstead, 2343 North Blvd., Houston, Tex. 77098

[21] Appl. No.: 34,474

[22] Filed: Mar. 19, 1993

[51] Int. Cl.[5] ..... F16K 5/04; F16K 31/44

[52] U.S. Cl. ..... 251/144; 251/287; 251/291; 251/310; 251/352; 184/1.5

[58] Field of Search ..... 251/144, 149.8, 287, 251/291, 310, 339, 352; 184/1.5

[56] References Cited

U.S. PATENT DOCUMENTS

| | | | |
|---|---|---|---|
| 44,596 | 10/1864 | Burkhardt | 251/149.8 |
| 1,240,161 | 9/1917 | Olds | 251/310 X |
| 1,296,239 | 3/1919 | Van Meter | 251/144 |
| 2,901,211 | 8/1959 | Epp | 251/352 X |
| 3,507,299 | 4/1970 | Murdock | 251/144 X |
| 3,598,150 | 8/1971 | Nolan | 251/352 X |
| 3,806,085 | 4/1974 | Codo | 184/1.5 X |
| 3,910,550 | 10/1975 | Nelson | 184/1.5 X |
| 4,280,498 | 7/1981 | Jensen | 251/352 X |
| 4,314,689 | 2/1982 | Wilson | 251/144 X |
| 4,318,531 | 3/1982 | Carlson | 251/144 |
| 4,632,362 | 12/1986 | Lucking | 251/310 |
| 4,756,349 | 7/1988 | Atkins | 184/1.5 X |
| 4,951,723 | 8/1990 | Hoeptner, III | 184/1.5 X |

*Primary Examiner*—John Rivell
*Attorney, Agent, or Firm*—Harrison & Egbert

[57] ABSTRACT

A valved drain plug apparatus having a valve body with a bore extending therethrough and an opening along a surface extending into the bore, and an insert element rotatably mounted within the bore of the valve body. The insert element has a hole along one surface. The insert element is movable between a first position in which the hole is aligned with the opening and a second position in which the insert element closes the bore of the valve body. The insert element has a generally tubular configuration being open at one end and closed at another end. A key member is detachably received by the insert element. The key member serves to rotate the insert element between the first and second positions. The key member includes a body member having an interior passageway extending therethrough and in communication with the bore of the valve body. The key member also includes a key extending upwardly from the body member so as to engage a key slot formed on a surface of the insert element.

16 Claims, 3 Drawing Sheets

VALVED DRAIN PLUG APPARATUS

TECHNICAL FIELD

The present invention relates to a drain plug apparatus, in general. More particularly, the present invention relates to valve elements for use in conjunction with drain plugs.

BACKGROUND ART

In virtually all motor vehicles, an oil drip pan is provided at the bottom of the engine. The purpose of the oil drip pan is to receive the accumulation of motor oils. Periodically, it is necessary to change this engine oil. The oil change is accomplished by the removal of a drain plug on the oil drip pan. The removal of the drain plug allows the oil to flow from the oil drip pan. After the accumulation of oil has been removed from the oil drip pan, then the drain plug is threadedly fastened in its original position on the oil drip pan. A new supply of oil can then be introduced into the vehicle engine.

One of the common sources of pollution is the oil which has been removed from the oil drip pan of a motor vehicle. In many locations, the oil is simply drained into municipal sewage systems. Although such activities are illegal, they often go on, much to the detriment of the water supply of the municipality. Other times, the oil is removed and poured into containers. Often, these containers are disposed of in a haphazard manner so that oil pollution is the result. These occurrences of oil pollution are not always intentional. Often these activities are simply the result of carelessness and accident.

It is an object of the present invention to provide a drain plug that facilitates the automatic disposal of engine oils.

It is another object of the present invention to provide a valved drain plug that operates without removal of the drain plug itself.

It is still a further object of the present invention to provide a valved drain plug that is easy to use, relatively inexpensive, and easy to manufacture.

These and other objects and advantages of the present invention will become apparent from a reading of the attached specification and appended claims.

SUMMARY OF THE INVENTION

The present invention is a valved drain plug apparatus that comprises a valve body having a bore extending therethrough and an opening along one surface of the valve body. An insert element is rotatably mounted within the bore of the valve body. This insert element has a hole along one surface. The insert element is movable between a first position in which the hole is aligned with the opening and a second position in which the insert element closes the bore of the valve body.

The valve body has a generally cylindrical outer surface. This cylindrical outer surface has threads formed thereon so as to allow the valve body to be received by an oil drip pan. The valve body has a head formed adjacent to these threads. The bore extends through the head so as to open at an outer surface of the head. This bore is closed at the end opposite the head. The valve body has a cap on an end opposite the head. This cap is in sealed engagement with the valve body.

The insert element has a generally tubular configuration. This tubular configuration opens at one end and is closed at the other end. The hole opens to an interior of the tubular configuration of the insert element. The insert element is supported on a shoulder formed in the bore of the valve body. This insert element has a stop formed on a bottom edge thereof. The stop is for abutment with a surface in the bore of the valve body The insert element has at least one key slot extending upwardly from said bottom edge. This key slot is for the purpose of receiving a portion of a key member. The insert element has a first key slot extending through a surface of the insert element. The insert element also has a second key slot which is angularly displaced from the first key slot.

The present invention includes a key means which is detachably received by the insert element with the valve body. This key means serves to rotate the insert element relative to the valve body between the first and second positions. The key means comprises a body member having an interior passageway extending therethrough. This interior passageway is in communication with the bore of the valve body. A key extends upwardly from the body member so as to engage a key slot formed on the insert element. The body member also includes a wing section extending outwardly transversely relative to the interior passageway. An abutment section is formed at one end of the interior passageway. This abutment section is in juxtaposition with a bottom of the valve body such that the interior passageway aligns with the bore of the valve body. A nozzle section is formed at an end of the interior passageway opposite the abutment section. This nozzle section allows for the receipt of a tube extending from the key means and from the valve body. The tube is suitable for allowing oils, and other liquids, to drain from the interior of the oil drip pan into a closed container.

The present invention is particularly adapted for use with the oil drip pan of a motor vehicle. It is important to note, however, that the present invention could be adapted to be used as part of a liquid sampling system for storage tanks in industrial applications.

DETAILED DESCRIPTION OF THE INVENTION

Figure 1:
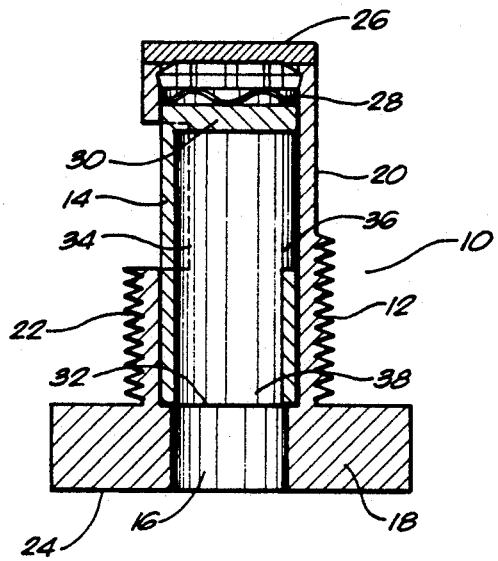
FIG. 1 is a cross-sectional view of the valved drain plug apparatus as shown in its closed position.

Referring to FIG. 1, there is shown at 10 the valved drain plug apparatus in accordance with the preferred embodiment of the present invention. The valved drain plug apparatus 10 includes a valve body 12 and an insert element 14. As shown in FIG. 1, the valve body apparatus 10 is shown in its closed position so that oil does not flow from the exterior of the valve body through the interior bore 16.

The valve body 12 has an appearance of a conventional drain plug. Specifically, the valve body 12 includes a head 18 at one end and a cylindrical body portion 20 extending upwardly therefrom. A threaded section 22 is provided along the cylindrical outer surface of the body portion 20. The threads 22 are suitable for receipt within an oil drip pan. The head 18 has a hexagonal configuration so that it can be installed by a conventional box end wrench. When the head 18 is tightened, the valve body 12 will be received within the interior of the oil drip pan. Once the head 18 is tightened, in a conventional fashion, then oil will be retained within the interior of the oil drip pan without flowing out of the bore 16.

The bore 16 extends from the end surface 24 of head 18. The bore 16 extends into the cylindrical body 20 of the valve body 12. A cap 26 is affixed to the opposite end of the cylindrical body 20 from the head 18. The cap 26 is fitted over the end of the bore 16 so as to seal the interior of the valve body 12. A spring 28 is interposed between cap 26 and the top surface 30 of the insert element 14. The spring 28 serves to fix the insert element 14 in a proper position in juxtaposition against the shoulder 32 on the interior of the bore 16 of valve body 12.

Importantly, an opening 34 (shown in dotted line fashion) is formed along a surface of the valve body 12. The opening 34 extends so as to open into the bore 16 of the valve body 12. Without the insert element, oil would flow freely into the bore 16 through the opening 34. However, because of the installation of the insert element 14, the surface of the insert element 14 serves to block any flow of oil through the opening 34, as illustrated in FIG. 1.

As can be seen, the insert element 14 has a generally cylindrical configuration. The insert element 14 is rotatably mounted within the bore 16 of the valve body 12. As can be seen, the insert element 14 has a hole 36 formed along one surface of the valve body. In the position illustrated in FIG. 1, this hole 36 is in juxtaposition with an interior wall of the valve body 12 removed from the opening 34. The tubular configuration of the insert element 14 is closed at the upper end 30. The tubular configuration of the insert element 14 is open at the end 38 so as to allow any oil received therewithin to flow out of the bore opening 16 in the head 18 of the valve body 12. As can be seen, the insert element 14 rests upon the shoulder 32 formed in the bore 16.

Figure 2:
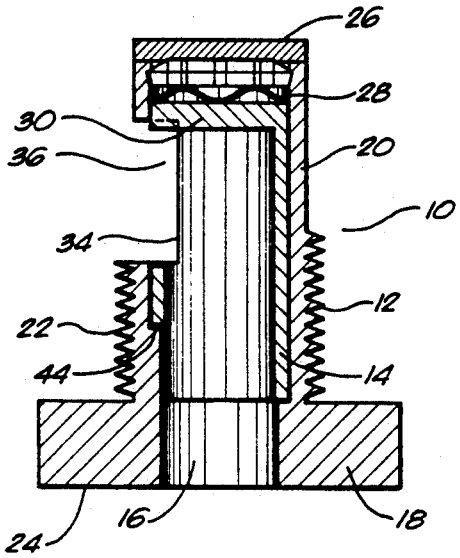
FIG. 2 is a cross-sectional view in side elevation of the valved drain plug apparatus in its open position.

The insert element 14 is shown in a second position in which the insert element 14 closes the bore 16 of the valve body 12. However, as can be seen in FIG. 2, the insert element 14 is rotatable so as to cause the hole 36 to be placed in alignment with the opening 34. This causes oil to flow into the interior of bore 16 and out of the end 24 of the valve body 12.

As can be seen in FIG. 2, the insert element 14 has been rotated from the position shown in FIG. 1 to a position in which the hole 36 of the insert element 14 is in alignment with the opening 34 of the valve body 12. As can be seen, the insert element 14 is supported upon another shoulder area 44 on the interior of bore 16 of valve body 12. In the position shown in FIG. 2, oil will enter in the direction of the arrow. The oil will flow into the opening 34 of the valve body 12 and into the hole 36 of the insert element 14. As the oil enters the bore 16, it will flow downwardly so as to exit at the end 24 of the head 18. By simply rotating the insert element 14 from its second position to its first position (illustrated in FIG. 2), a complete draining of the oil drip pan can be achieved. There is no need to remove the valve body 12 from its threaded connection with the oil drip pan. After the oil has been effectively removed from the oil drip pan, the insert element 14 is rotated back to the position illustrated in FIG. 1. When the insert element 14 has been so rotated, the oil is retained within the oil drip pan without leakage. It should be noted that suitable seals can be provided between the insert element 14 and the valve body 12 so as to avoid any problems associated with leakage between each of the elements. Additionally, alternative mechanisms can be employed so as to secure the insert element 14 in its proper position within the valve body 12. For example, under alternative configurations, it may not be necessary to include the cap 26, or the spring 28, for the purpose of retaining the insert element 14.

Figure 3:
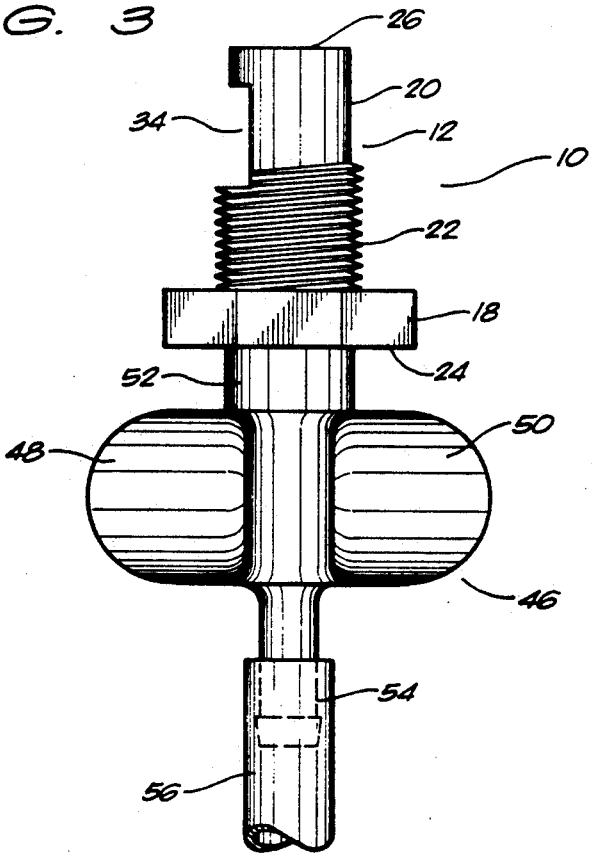
FIG. 3 is a side elevational view showing the valved drain plug apparatus with the key connected thereto.

Importantly, FIG. 3 illustrates the valved drain plug 10 as including a key member 46. The key member 46 serves the purpose of rotating the insert element 14 between the positions shown in FIGS. 1 and 2. Since the key element 46 is important to the operation of the apparatus 10, but is detachable, the embodiment shown in FIG. 3 should be considered as an alternative embodiment of the present invention. However, the key member 46 is important to the proper functioning of the present invention since it allows any oil removed from the interior of the oil drip pan to be properly delivered to a closed container exterior of the key member 46.

In FIG. 3, the exterior configuration of the valved drain plug apparatus 10 can be seen. Specifically, it can be seen that the valve body 12 has a generally cylindrical configuration with threads 22 along one surface. A hexagonal head 18 is positioned at the end of the threads 22. The cylindrical body 20 extends upwardly so as to be received within the interior of the oil drip pan. The opening 34 is particularly illustrated. It can be seen that the opening 34 extends from the top surface 26 downwardly to an edge of the threads 22. Opening 34 can be opened and closed with the proper manipulation of the insert element.

The key member 46 has an interior passageway extending therethrough. The key member 46 is detachably received by the insert element 14 within the interior of valve body 12. In the arrangement shown in FIG. 3, the key member 46 is suitable for moving the insert element between the position shown in FIGS. 1 and 2. The key member 46 includes a body member 48 which has an interior passageway extending therethrough. This interior passageway will be in communication with the bore 16 on the interior of the valve body 12. As will be described hereinafter, a key extends upwardly from the body member 48 so as to engage a key slot formed on a surface of the insert element 14. To facilitate the operation of the present invention, the body member 48 includes a wing section 50 which extends outwardly transversely relative to the interior passageway. The wing section 56 facilitates the hand operation of the present invention by allowing the auto mechanic to simply rotate the key member 46 for the purpose of moving the insert element 14 on the interior of valve body 12. An abutment section 52 is provided at one end of the interior passageway. As can be seen, this abutment section 52 is in juxtaposition with the bottom surface 24 of valve body 12. The arrangement is such that the interior passageway of the body member 48 aligns with the bore 16. A nozzle section 54 is provided at the end of the interior passageway opposite the abutment section 52. As can be seen, the nozzle section 54 is suitable for the receipt of a tube 56 extending therefrom. Tube 56 is slidably received over the nozzle section 54. Tube 56 extends to a closed container or other storage facility. In this manner, when the key member 46 is fastened to the valved drain plug apparatus 10, the pouring of the oil through the bore 16 of the valve body 12 will pass to a desired location. By transmitting such oil to a sealed container, environmental pollution can be prevented. Since the valved drain plug 10 remains in its threaded connection to the oil drip pan, there is no leakage during the transmission of oil.

Figure 4:
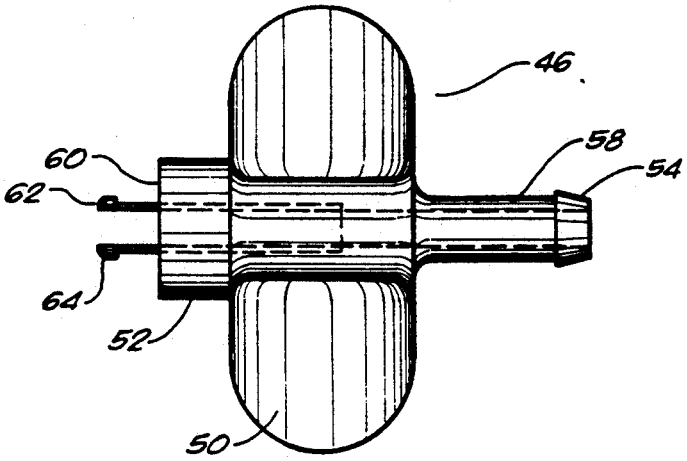
FIG. 4 is a side elevational view of the key member of the present invention.

FIG. 4 illustrates the interior passageway 58 of the key member 46. As can be seen, the interior passageway 58 extends from the end 60 of the abutment section 52 and opens at the end of the nozzle section 54. The wing section 50 extends outwardly from the interior passageway 58 in a transverse direction. The wing section 56 has an exaggerated oval configuration. Importantly, a first key 62 extends outwardly from the end 60 of the abutment section 52. A second key 64 also extends outwardly from the end 60 of the abutment section 52. As can be seen, the first key 62 and the second key 64 are angularly displaced and in generally parallel alignment.

Figure 5:
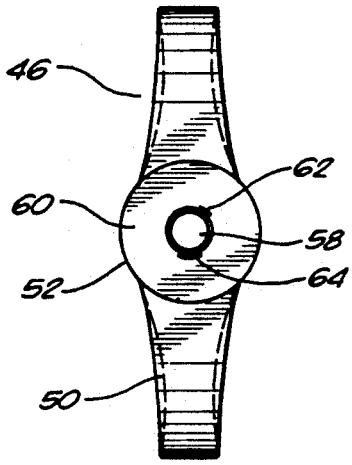
FIG. 5 is a top plan view of the key member of the present invention.

An end view of the key member 46 is illustrated in FIG. 5. As can be seen, the top surface 60 of the abutment section 52 has a generally circular configuration. This circular configuration is proper for matching with the end surface 24 of the head 18 of the valve body 12. The wing sections 50 extend outwardly transverse to the longitudinal axis of the interior passageway 58. The interior passageway 58 opens at the top surface 60 of the key member 46. The keys 62 and 64 are shown in their offset alignment. This offset alignment serves to assure that the key member 46 is properly installed whenever it is desired to rotate the insert element 48 relative to valve body 12.

Figure 6:
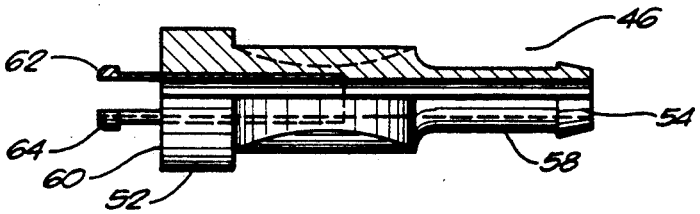
FIG. 6 is a partial cross-sectional view of the key member of the present invention.

FIG. 6 shows a cross-sectional view of the interior of the key member 46. The interior passageway 58 opens at the end of nozzle 54 and also opens at the end 60 of the abutment section 52. Keys 62 and 64 extend outwardly from the end surface 60. The interior passageway 58 should have a suitable diameter so as to allow a free flow of oil from the valve body 12. Seals, and other items, may be incorporated onto the surface 62 of abutment member 52 so as to assure a tighter, more liquid-tight, fit between the key member 46 and the end surface 24 of the valve body 12.

Figure 7:
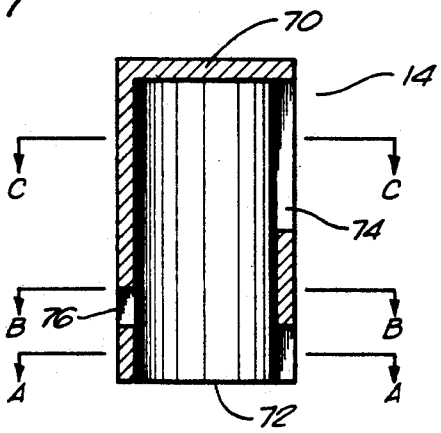
FIG. 7 is a cross-sectional side view of the insert element of tho present invention.

Importantly, FIG. 7 shows the configuration of the insert element 14. The insert element 14 has a generally cylindrical configuration with one closed end 70 and an open end 72. A hole 74 is formed through one of the walls of the insert element 14 so as to permit the flow of oil therethrough. As will be described hereinafter, a slotted opening 76 is formed along the surface of the walls of the insert element 14 so as to allow for the receipt of the keys 62 and 64.

Figure 8:
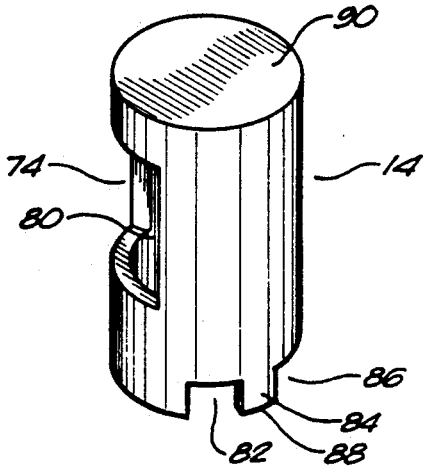
FIG. 8 is a perspective view of the insert element of the present invention.

FIG. 8 shows a perspective view of the insert element 14. As can be seen, the insert element 14 has a generally cylindrical configuration. The hole 74 is formed through one wall of this cylindrical configuration. A tubular interior opening 80 allows the oil to flow through the hole 74 and outwardly through the bottom 82 of the insert element 14. As can be seen in FIG. 8, stop elements 84 are provided so as to prevent excessive rotation of the insert element 14. After the insert element 14 has been rotated a desired amount, the stop 84 will come into abutment with the shoulder 44 of the valve body 12. This will prevent excessive rotation and also provide assurance that the valve body is properly closed. The open area 86 at the bottom edge of the insert element 14 allows the insert element 14 to be supported upon shoulder 44 and be rotated hereon. The bottom edge 88 of the stop element 84 will contact the shoulder 32 on the interior of bore 16. As was described in conjunction with FIGS. 1 and 2, the spring 28 will be in abutment with the top surface 90 of the insert element 14. The use of the spring assures that the insert element 14 is properly juxtaposed against the shoulders on the interior of the bore 16 and serves to establish a tight fit between the insert element 14 and the bore 16.

Figure 9A:
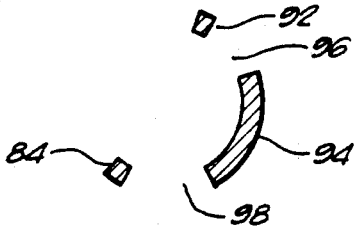
FIG. 9A is a cross-sectional view taken across lines A—A of FIG. 7.

FIG. 9*a* is a cross-sectional view at the very bottom of the insert element 14. As can be seen, the stops 84 and 92 are provided. A surface 94 will move along the shoulder 32 on the interior of valve body 12. During full rotation of the insert element 14, the stops 84 and 92 will come into proper abutment with the shoulder surface 44 on the interior of valve body 12.

Figure 9B:
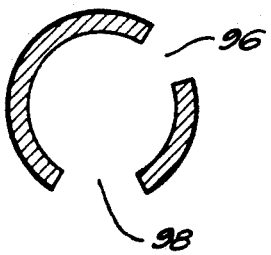
FIG. 9B is a cross-sectional view taken across lines B—B of FIG. 7.

FIG. 9*b* shows a cross-sectional view at a higher level of the insert element 14. Importantly, FIG. 9*b* shows a slot 96 and a slot 98 formed through the walls of the insert element 14. Slots 96 and 98 are configured so as to receive the keys 62 and 64 on the key member 46. The keys 62 and 64 extend upwardly through the bottom edge 88 of the insert element 14 so as to be received within the slots 96 and 98. The angularly offset arrangement of the keys 62 and 64 is shown by the angularly offset nature of the slots 96 and 98.

Figure 9C:
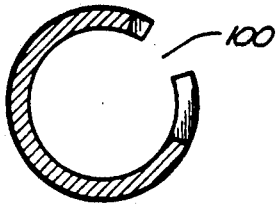
FIG. 9C is a cross-sectional view as taken across lines C—C of FIG. 7.

FIG. 9*c* shows the hole 100 which is used to allow the passage of oil therethrough. In the closed position, this opening 100 will be against a solid interior wall of the valve body 12. In the open position, slot 100 will be aligned with the opening 34 of the valve body 12.

In normal use, the valve drain plug 10 of the present invention will be in its closed position. In its closed position, the oil will be retained within the oil drip pan. The drain plug must, of course, be closed so as to allow the crank case of the automobile to be filled with oil. Additionally, assurances should be made that the drain plug is closed before oil can be introduced into the crank case. As such, the configuration of slots and shoulders is particularly important. When, the keys 62 and 64 are inserted into slots 96 and 98 the drain plug 10 is in its closed position. When the slots 96 and 98 are rotated, they will reside over the shoulder 44 on the interior of drain plug 12. This rotation makes it impossible to remove the key member 46 since the slots 96 and 98 are positioned over a shoulder on the interior of bore 16. As such, the key member 46 will be affixed to the valve body 12 whenever the drain plug is in its open position. When the insert element 14 is rotated to its "closed" position, then the slots 96 and 98 will be properly aligned with the shoulders so as to allow for the sliding removal of the keys 62 and 64 from the interior of the insert element 14. As such, the configuration of shoulders and slots assures that the key member 46 can only be removed when the drain plug is closed. This serves to prevent the accidental loss of oil when the drain plug is open.

The valve arrangement shown in the present invention provides an oil drain and capture arrangement for automobiles, trucks, and heavy equipment engines. The valved drain plug 10 of the present invention replaces the normal drain plug in the oil pan. The drain plug of the present invention is attached with a standard box end wrench. Once in place, the valve can only be opened with the special key member 46 provided as part of the present invention. When the valve is opened, oil will drain through the key member 46. A flexible tube, attached to the key member 46, leads to a flexible closed bucket. Once the tool is in place, with the valve opened, the tool cannot be removed until the valve is shut. When the oil draining is complete, the valve is closed, the tool removed, and the flexible bucket sealed.

It should be noted that the present invention is also adaptable to liquid sampling systems for use with storage tanks in industrial applications. Additionally, the present invention is adaptable to various systems that utilize drain plugs.

The foregoing disclosure and description of the invention is illustrative and explanatory thereof. Various changes in the details of the illustrated configuration ma be made within the scope of the appended claims without departing from the true spirit of the invention. The present invention should only be limited by the following claims and their legal equivalents.

I claim:

1. A valved drain plug apparatus comprising:

a valve body having a bore extending therethrough, said valve body having an opening along a surface, said opening extending into said bore; and an insert element rotatably mounted within said bore of said valve body, said insert element having a hole along one surface, said insert element movable between a first position in which said hole is aligned with said opening and a second position in which said insert element closes said bore of said valve body, said insert element supported on a shoulder formed in said bore of said valve body, said insert element having a stop formed on a bottom edge thereof, said stop for abutment with a surface in said bore of said valve body, said insert element having at least one key slot extending upwardly from said bottom edge, said key slot for receiving a portion of a key element.

2. The apparatus of claim 1, said valve body having a generally cylindrical outer surface, said cylindrical outer surface having threads formed thereon, said valve body having a head formed adjacent said threads.

3. The apparatus of claim 2, said bore extending through said head so as to open at an outer surface of said head, said bore being closed at an end opposite said head.

4. The apparatus of claim 2, said bore extending through said valve body, said valve body having a cap on an end opposite said head, said cap in sealed engagement with said valve body.

5. The apparatus of claim 1, said insert element having a generally tubular configuration, said tubular configuration open at one end, said hole opening to an interior of said tubular configuration.

6. The apparatus of claim 1, said insert element having a first key slot extending through a surface of said insert element, said insert element having a second key slot angularly displaced from said first key slot.

7. The apparatus of claim 1, further comprising:

a key means detachably received by said insert element, said key means for rotating said insert element relative to said valve body between said first and second positions.

8. A valved drain plug apparatus comprising:

a valve body having a bore extending therethrough, said valve body having an opening along a surface, said opening extending into said bore;

an insert element rotatably mounted within said bore of said valve body, said insert element having a hole along one surface, said insert element movable between a first position in which said hole is aligned with said opening and a second position in which said insert element closes said bore of said valve body; and a key means detachably received by said insert element, said key means for rotating said insert element relative to said valve body between said first and second positions, said key means comprising:

a body member having an interior passageway extending therethrough, said interior passageway in communication with said bore of said valve body; and a key extending upwardly from said body member, said key engaging a key slot formed on said insert element.

9. The apparatus of claim 8, said body member comprising:

a wing section extending outwardly transversely relative to said interior passageway; and an abutment section at one end of said interior passageway, said abutment section in juxtaposition with a bottom of said valve body such that said interior passageway aligns with said bore of said valve body.

10. The apparatus of claim 9, said body member further comprising:

a nozzle section at an end of said interior passageway opposite said abutment section, said nozzle section for receipt of a tube extending from said key means.

11. A valved drain plug apparatus comprising:

a valve body having a bore extending therethrough, said valve body having an opening along a surface, said opening extending into said bore;

an insert element rotatably mounted within said bore of said valve body, said insert element having a hole along one surface, said insert element movable between a first position in which said hole is aligned with said opening and a second position in which said insert element closes said bore of said valve body; and a key means detachably received by said insert element, said key means for rotating said insert element relative to said valve body between said first and second positions, said insert element having at least one key slot extending upwardly from a bottom edge thereof, said key means comprising:

a body member having an interior passageway extending therethrough, said interior passageway in communication with said bore of said valve body; and a key extending upwardly from said valve body, said key engaging said key slot of said insert element.

12. The apparatus of claim 11, said insert element having a first key slot extending through a surface of said insert element, said insert element having a second key slot angularly displaced and in parallel relationship with said first key slot, said key means further comprising:

a first key extending upwardly from said body member, said first key engaging said first key slot; and a second key extending upwardly from said body member in generally parallel relationship to said first key, said second key engaging said second key slot of said insert element.

13. The apparatus of claim 11, said insert element having a generally tubular configuration, said tubular configuration open at one end, said hole opening to an interior of said tubular configuration.

14. The apparatus of claim 11, said body member comprising:

a wing section extending outwardly transverse relative to said interior passageway;

an abutment section at one end of said interior passageway, said abutment section in juxtaposition with a bottom of said valve body such that said interior passageway aligns with said bore; and a nozzle section at an end of said interior passageway opposite said abutment section, said nozzle section for receipt of a tube extending from said key means.

15. The apparatus of claim 11, said valve body having a generally cylindrical outer surface, said cylindrical outer surface having threads formed therein, said valve body having a head formed adjacent said threads, said bore extending through said head so as to open at an outer surface of said head, said bore being closed at an end opposite said head.

16. The apparatus of claim 13, said insert element supported on a shoulder formed in said bore of said valve body, said insert element having a stop formed on a bottom edge thereof, said stop for abutment with a surface in said bore of said valve body.

* * * * *